US005342508A

United States Patent [19]

Transfeld

[11] Patent Number: 5,342,508

[45] Date of Patent: Aug. 30, 1994

[54] METHOD OF ADSORPTIVE PURIFICATION OF VEGETABLE AND/OR MINERAL OILS AND FATS

[75] Inventor: Peter Transfeld, Magdeburg, Fed. Rep. of Germany

[73] Assignee: Ohmi Forschung und Ingenieurstechnik GmbH, Magdeburg, Fed. Rep. of Germany

[21] Appl. No.: 916,505

[22] Filed: Jul. 20, 1992

[30] Foreign Application Priority Data

Jul. 23, 1991 [DE] Fed. Rep. of Germany ..... 4124331

[51] Int. Cl.[5] ..... C10G 25/00; C10G 25/06

[52] U.S. Cl. ..... 208/299; 208/302; 208/303; 208/304; 210/193; 554/191

[58] Field of Search ..... 208/299, 302, 303, 304; 210/193, 917; 554/191; 585/820

[56] References Cited

U.S. PATENT DOCUMENTS

| | | | |
|---|---|---|---|
| 1,809,862 | 6/1931 | Moorman et al. | 208/303 |
| 1,849,653 | 3/1932 | Baylis | 208/299 |
| 2,139,161 | 12/1938 | Hutchins et al. | 208/303 |
| 2,618,644 | 11/1952 | Bailey | 210/193 |
| 2,691,665 | 10/1954 | Bailey | 203/92 |
| 2,717,256 | 9/1955 | McMichael et al. | 208/303 |
| 2,849,120 | 8/1958 | McMichael | 210/193 |

FOREIGN PATENT DOCUMENTS

| | | |
|---|---|---|
| 238924 | 9/1986 | Fed. Rep. of Germany . |
| 382716 | 12/1964 | Switzerland . |
| 700234 | 11/1953 | United Kingdom . |

*Primary Examiner*—R. Bruce Breneman
*Assistant Examiner*—Walter D. Griffin
*Attorney, Agent, or Firm*—Herbert Dubno

[57] ABSTRACT

A method for the adsorptive purification of vegetable and/or mineral oils and fats works with a multi-stage counter flow process. At least a part of the solid phase leaving the first separating stage is mixed in batches or continuously with a part of the purified oil or fat leaving the last separating stage. The mash thereby obtained is fed to a subsequent filter.

11 Claims, 4 Drawing Sheets

METHOD OF ADSORPTIVE PURIFICATION OF VEGETABLE AND/OR MINERAL OILS AND FATS

FIELD OF THE INVENTION

The present invention relates to a method of adsorptive purification of vegetable and/or mineral oils and fats in a multi-stage counterflow process. The invention also relates to an apparatus for carrying out this method.

BACKGROUND OF THE INVENTION

Methods for the adsorptive purification of oils and fats have been known for a long time. Examples are for instance the extraction and purification of oils for the production of food, in particular by means of bleaching earth or activated carbon. These methods contact an adsorbent with the oil to be purified. The adsorbent, which is provided with many fine pores, takes up the pigmentations and dirt particles to be removed from the oil and, after the contacting process, is removed again from the oil, which is thereby purified and bleached.

The purification is frequently carried out discontinuously in a batch process or continuously in a uni-directional flow, i.e. oil and fresh adsorbent are mixed continuously or discontinuously and then separated again. In so doing a adsorbent separated still has free adsorption capacity.

It would be far more effective in theory to use the counterflow principle. This means that there is fed initially to the oil still to be purified not fresh adsorbent, but rather an already used adsorbent originating from a later purification stage. In relation to the oil still unpurified here, however, it still possesses sufficient potential for the take-up of dirt particles. After this first purification stage, consisting of contacting the absorbent with the oil and subsequent separation, the pre-purified oil is now treated in a further pass with fresh adsorbent, which is capable of taking up the smaller quantity of dirt and pigmentations particles still present and thereafter still possesses sufficient free capacity for a second application. The now used adsorbent can then, as indicated above, be added once again at a later point in time to the first contacting stage, while the oil now significantly purified by means of two stages may be further processed.

In principle it is also possible to provide more than two such separating stages.

Despite the theoretical advantage involved, the counter flow principle is not applied in practice because of the considerable cost of the equipment required. The benefits, namely the savings on adsorbent, bear no relationship to the requirements for an additional plurality of stage and guiding of the counterflow.

Attempts, using ingenious solutions, to make the counterflow principle more effective by means of continuous, simple solid or liquid phases flowing against one another are known for example from East German Patent Application 238 924. Rotating liquid columns and heavy and light phases rising or falling are used there. There has been no lack of attempts, in the case of columns with rotating baffles, to exploit a centrifugal field to improve the separation effect. In this case a stream of fluid is generated in a cylindrical tube, as a result of which heavy particles dispersed in the fluid extend at random to form into rings rotating about the main axis of the chamber. Said particles may be liquid particles or solid particles. A further alternative to this is known from Swiss Patent 382 716.

The disadvantage of centrifugal extraction consists in the high investment and operating costs. The counter-rotating transport of oil and bleaching earth in said column leads as a result of insufficient stage separation to a clear loss of propulsive force and reduces the maximum bleaching earth savings possible by virtue of the counterflow principle.

There is known from GB Patent 700 234 a method for the purification or bleaching of oils, in which an already substantially purified mixture of oil and adsorption agents is run through a press covered with filter cake. The filter cake contains already partially spent adsorption agents. The purified oil flows through the channels and pores of the filter cake, it being virtually impossible for any exchange of materials to take place and hence also a re-mixing of the contaminants from the filter cake with the purified oil being excluded from the outset.

OBJECTS OF THE INVENTION

An object of the invention is to provide an improved method for the adsorptive purification of vegetable and/or mineral oils and fats. Another object is to provide an apparatus for carrying out the improved method and which enable the effectiveness of counterflow processes to be improved.

SUMMARY OF THE INVENTION

According to a first aspect, the invention provides a method of adsorptive purification of vegetable and/or mineral oils and fats in a multi-stage counterflow process comprising first and last separating stages and subsequent filter means, wherein at least part of the adsorbent leaving said first separating stage of said multi-stage process is mixed in batches or continuously with a part of the purified oil or fat leaving the last separating stage to produce a mash: The mash is fed to the subsequent filter.

According to a second aspect, the invention provides apparatus for carrying out adsorptive purification of vegetable and/or mineral oils and fats in a multi-stage counterflow process wherein there are provided at least first and second contact stages, first and second separating stages with respective solids and liquid component outlets, and a mixer having an inlet and an outlet, said contact stages and the separating stages are connected to one another according to the counterflow principle, the solids outlet of the first separating stage and the liquid component outlet of the second separating stage are connected in each case to said inlet of the mixer, and the outlet of the mixer is connected to an inlet of subsequent filter means.

BRIEF DESCRIPTION OF THE DRAWINGS

Preferred embodiments of the present invention will now be described, by way of example only, with reference to the accompanying drawing, of which.

SPECIFIC DESCRIPTION

Figure 1:
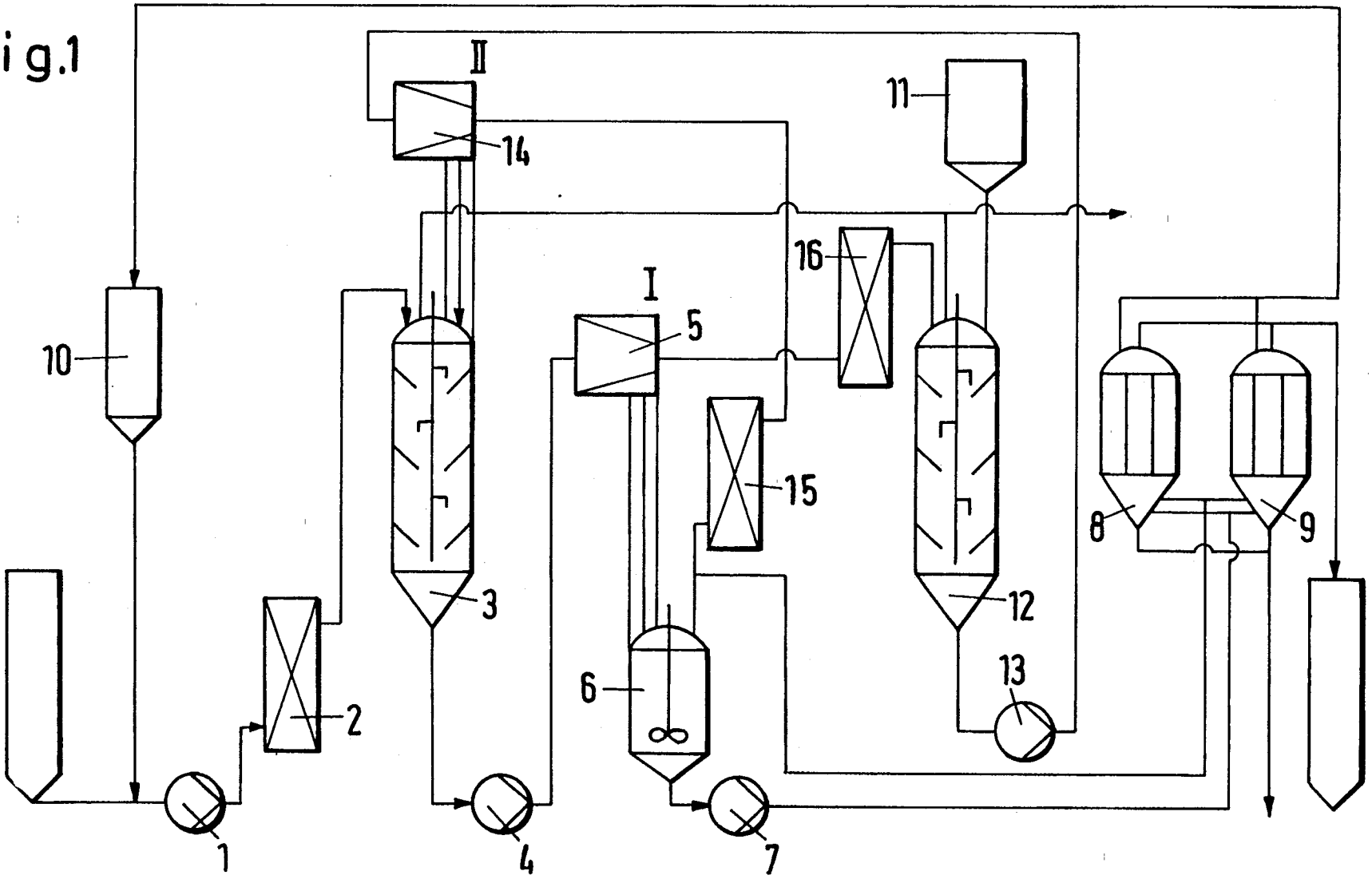
FIG. 1 is a diagrammatic representation of a first embodiment of an apparatus for carrying out the method.

Basically the invention provides a method in which at least part of the adsorbent leaving the first separating stage of the multi-stage process is mixed in batches or continuously with a part of the purified oil or fat leaving the last separating stage and the mash thereby obtained is fed to a subsequent filter.

This solution to the problem is surprising to the ordinary for skilled worker in this art, since it invites him to mix again with the adsorbent, i.e. the solid particles of the whole process which are most heavily polluted with dirt and pigment particles, and to feed to a subsequent filter, precisely at least that part of the oil which is freshly purified and already suitable in principle for further processing.

Precisely by this, at first sight seemingly absurd measure however it becomes possible to achieve a considerable improvement and simplification in the filter stage which is always required according to the adsorptive purification process. Previously, in fact, there was a tendency for the extremely fine particles which are still contained in the oil which has already passed through all the purification stages to construct very rapidly an impermeable filter layer in front of the filter membranes. A rapid rise in pressure resulted, which reduced the filtering effect of the cake and made continuous replacement of the filters necessary.

By means of the measure according to the invention there are now however also contained in the theoretically purified oil the comparatively large particles of the adsorbent. The latter also come to rest against the filter membranes of the filter stage and prevent the filter stage from being clogged.

Furthermore, use is made of an additional surprising effect, which has shown that the dirt and pigment particles taken up in the adsorbent return hardly at all into the purified oil out of the adsorbent. The periods of time over which this lacks of transfer occurs are extremely long in comparison with the other contact times, so that it is justifiable to add the adsorbent again to the purified oil. The effect may be reinforced in particular by a sudden fall in temperature taking place for the pre-contaminated adsorbent, in practice for example from 130° C. to 80° C. Those pores of the adsorbent particles which already contain dirt and pigment particles are thereby closed in keeping with the trend and prevent further escape of the pigment contained in them. The sudden fall in the temperature may be supported by corresponding measures in the purification cycle.

Experience has shown that the method permits savings of 40% on the bleaching earth used.

In a preferred embodiment the addition of the adsorbent to this oil is carried out only to part of the purified oil. The mash which forms is not fed to the filter continuously, but in batches or lots, and moreover directly for precoating, after a new or cleaned filter is employed- In this way the new filter is prevented immediately at the very outset from being loaded with the ultra-fine particles.

The continuous production of purified oil in the output of the filter stage may be ensured by the turbid oil collecting in the precoat phase being returned to the unpurified oil prior to the multi-stage counter flow process.

By means of this measure one of the two parallel filter stages is always in normal operation at just such time as the other one is being cleaned and subsequently precoated with the mash.

An additional advantage, which is ensured by the invention, consists in the fact that the ultra-fine adsorbent particles of the clarified oil may now be disposed of together with the adsorbent leaving the process. Previously it was necessary for the waste materials or adsorbates collecting in this way to be removed separately from the process, whereas now they may all collect in the filter. This increases the effectiveness of the counterflow process quite significantly and thus also makes it economical. Not only the amount of adsorbent required, but also the corresponding amount of waste or amount of adsorbate collecting, is reduced considerably, since now the advantages of the counter flow method which were mentioned in the preamble may be exploited, and hence the adsorptivity of the individual adsorbent particles be better deployed, and the latter thus collect as waste only on a reduced scale.

As an alternative to use only during the precoating, it is also preferable that two parallel connected subsequent filter stages be carried out and alternately disconnected, cleaned and precoated afresh after the last separating stage, so that a continuous discharge of purified oil or fat takes place.

There is the advantage also in this case that the disposal of the ultra-fine adsorbent particles may take place jointly with the main amount of adsorbent.

The invention also provides apparatus for carrying out the method, in which apparatus at least two contact stages, two separating stages and a mixer are provided, the contact stages and the separating stages are connected to one another according to the counterflow principle, the solids outlet of the first separating stage and the liquid component outlet of the second separating stage are connected in each case to the inlet of the mixer, and the outlet of the mixer is connected to the inlet of a subsequent filter.

It is particularly preferable here if the solids outlet of the first separating stage is arranged directly above the mixer.

It is also preferable if the solids outlet of the second separating stage is arranged directly above the first contact stage.

The arrangement of the outlets of the separating stages directly above the contact stages or the mixer prevents clogging, air contact with an oxidizing effect and expensive transport routes. The solids collecting fall only under the force of gravity directly out of the separating stage, for instance the decanter, into the mixer or the next contact stage. This increases the effectiveness of the whole process and substantially reduces equipment costs.

Such a layout also becomes possible because the mixed liquid/solid phases may now be transported upwards if necessary.

The method has proved particularly successful with dark initial oils heavily polluted with slimy substances and soaps, as well as oil for which low final color values are not required after the bleaching. This would be he case for instance with the bleaching prior to physical refining.

The separating stages are preferably formed by decanters, hydrocyclones or separators. Decanters have proved particularly suitable and reliable in initial experimental tests; with hydrocyclones, an even greater effectiveness may be achieved in certain circumstances.

Figure 2:
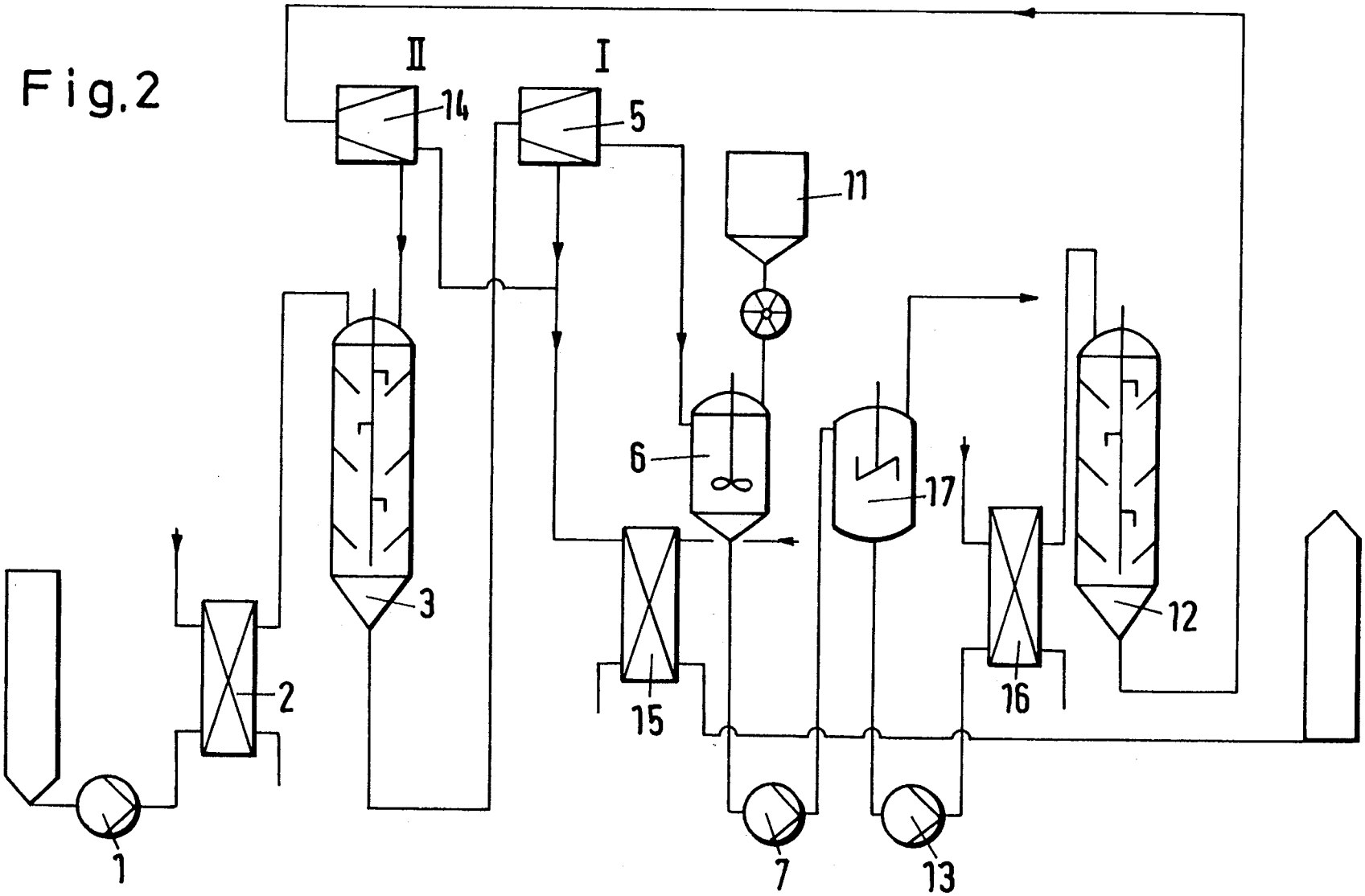
FIG. 2 is a diagrammatic representation of a second embodiment for carrying out an alternative method.

Referring to the drawing, in the embodiments of FIGS. 1 and 2 a two-stage adsorptive purification is provided; three-stage methods may also be effective in certain circumstances. In principle the method also possesses advantages if there are still further stages, but these advantages are cancelled out once again by the high costs of equipment.

In FIG. 1 the unpurified oil passes by means of a pump 1 into a heat exchanger 2 and is there heated to bleaching earth temperature. The heated oil passes into the bleaching apparatus, i.e. the contact stage 3.

There is it contacted with oil-containing adsorbent from the later process step.

Contact time, temperature and and desirable vacuum in the contact stage 3, the bleaching apparatus, are set optimally in accordance with the grade of oil used.

The suspension leaving the contact stage 3 is fed by means of pump 4 to a decanter 5. The decanter 5 separates the suspension into a solid and a liquid phase. The desired separating effect is set by regulation of a separating disc, a drum speed, a worm speed and the throughput. The decanter 5 possesses two outlets for the two phases leaving it.

The solid phase passes directly through a vertically arranged fall shaft into the mixing vessel or mixer 6 arranged below the decanter 5. The solid phase is mashed in the mixing vessel 6 with clarified oil from a later process step to an easily pumpable suspension. Said mash is fed by means of a pump 7 to a respective one of the two filters 8 or 9. The switching is simply indicated diagrammatically. In this way the particular filter employed is precoated, i.e. a filter layer is built up. In so doing preferably the whole contents of the mixing vessel or mixer 6 are fed to the particular filter 8 or 9 employed.

The liquid phase, i.e. the oil already clarified to a certain extent, leaving the decanter, i.e. the separating stage 5, is once more heated in a heat exchanger 16 to contacting temperature and fed to a contact stage 12, which is once again a bleaching apparatus.

At the same time there is fed to the contact stage 12 fresh adsorbent from the adsorbent vessel 11. Bleaching temperature, amount of adsorbent, contacting temperature and contacting time are selected in accordance with the grade of oil used.

The suspension leaving the second contact stage 12 is fed by means of a pump 13 to a decanter, i.e. the separating stage 14. In the separating stage 14 there takes place the separation of the suspension into a solid and a liquid phase. Separating disc, drum speed, worm speed and throughput are selected in accordance with the desired separating effect.

The solid phase passes via a vertically arranged fall shaft directly into the bleaching apparatus located thereunder, namely, the first contact stage 3. It is here mixed with the still unpurified oil, as described above, and then further processed.

The liquid phase from the separating stage 14 is on the other hand adjusted in a heat exchanger 15 to the optimal temperature. The liquid phase or a part of it is now either fed to the filter 8 or 9 for final filtering or clarification or if necessary conveyed into the mixing vessel or mixer 6 for the forming of mash for the precoating step.

The bleaching apparatuses or contact stages 3 and 12 may be operated according to requirements under standard pressure, vacuum or protective gas.

The method of operation described allows adsorbent to be used twice, so that the adsorptive power may be better exploited. Savings on adsorbent of up to 50% are thereby achieved, depending on oil grade and type of bleaching earth.

The method makes it possible for the solid phase leaving the decanter or the separating stage 5 to be mixed batch-wise with clarified oil from the decanter or the separating stage 14 and to be used in the filters 8 and 9 as a precoating medium. This phase may thereby be subjected to the usual deoiling in the filter. At the same time the filtering effect for the clarified oil which comes from the decanter or the separating stage 14, and which contains above all fine adsorbent particles, is improved considerably. Contaminated product from filters 8 and 9 may be returned to the pump 1 via the vessel 10.

As a result of the mixing of the adsorbent loaded with contaminants with oil clarified in a decanter and at a temperature according to oil grade the equilibrium state of the loaded adsorbent remains virtually unchanged. This means that the contaminants do not desorb into the oil. The equilibrium state of the oil-containing adsorbent precoated in the filter changes hardly at all as a result of the loading with the purified oil and is in addition receptive to further contaminants.

In this way the filtration of the solid phase of the first stage and of the liquid phase of the last stage in the same filter becomes possible. The solid phase of the first stage may be reduced in the same filter to the desired residual oil content by special treatment of the filter layer.

It is furthermore possible to apply the known counter flow with low expenditure on equipment and high savings. The application of the counter flow principle in the bleaching of vegetable and mineral oils and fats was achieved with considerable savings on bleaching earth, or adsorbent clay.

The second embodiment will now be discussed with reference to FIG. 2 and with examples. There is fed continuously to the whole plant by means of a pump 1 rape oil (carotene content 32.3 mg/kg, pheophetene content 13.8 mg/kg, iodine color index 46). During passage through a heat transfer device or heat exchanger 2 a heating of the rape oil to 90° C. takes place. Upstream of the reaction vessel or the contact stage 3 the rape oil is mixed with the solids-enriched phase from the decanter or the separation stage 14. In the contact stage 3 an agitator contacts both phases, so that partial adsorption is brought about.

The bleaching earth-oil mixture leaving the contact stage 3 is partially separated in a decanter or a separating stage 5. The solids-enriched phase is combined with a phase with low solids content from another separating stage 14 and passed to a heat exchanger 15. The phase with low solids content is fed to the mixer 6. In the mixer 6 the mixing of the lean phase from the decanter or the separating stage 5 with 7.5 kg of bleaching earth per ton of rape oil from the storage or adsorbent vessel 11 takes place.

A pump 7 conveys the bleaching earth-oil mixture into the vacuum drier 17, where the mixture is dried and degassed.

By means of a pump 13 the dried and degassed bleaching earth-oil suspension is conveyed continuously through the subsequent units of the apparatus. A heat exchanger 16 heats the suspension to 100° C. In the second contact stage 12, a further reaction vessel, the second bleaching stage is carried out such that the bleached rape oil exhibits a content of only 1.47 mg/kg carotene, 1.41 mg/kg pheophetene and iodine color index 8.5. If, compared with this, rape oil of the same initial quality is bleached with 7.5 kg/t bleaching earth in the batch process under vacuum conditions (50 hPa) at 100° C. until equilibrium is obtained, then the corresponding values of 1.53 mg/kg for carotene, 1.49 mg/kg for pheophetene and a 9.6 iodine color index are high in comparison. In order to achieve with batch bleaching the same iodine color index as with the continuous counter flow process in stages according to the invention, a bleaching earth amount of 8.2 kg/t is required.

The bleaching earth-rape oil suspension coming from the reaction vessel, the contact stage 12, is separated by means of decanter or separating stage 14 into a solids-enriched phase and one with a low solids content.

While the solids-enriched phase is fed to the preceding bleaching stage in the reaction vessel or the separating stage 3, the phase with low solids content from the separating stage 14, which is mixed with the solids-rich phase from the separating stage 5, leaves the process.

It will be further noted as an example that the already largely purified oils (at 14) exhibit 30 mg/kg carotene content, whereas the unpurified oils entering the contact stage 3 from the pump 1 vial the heat exchanger 2 exhibit a carotene content of 30,000 mg/kg.

Figure 3:
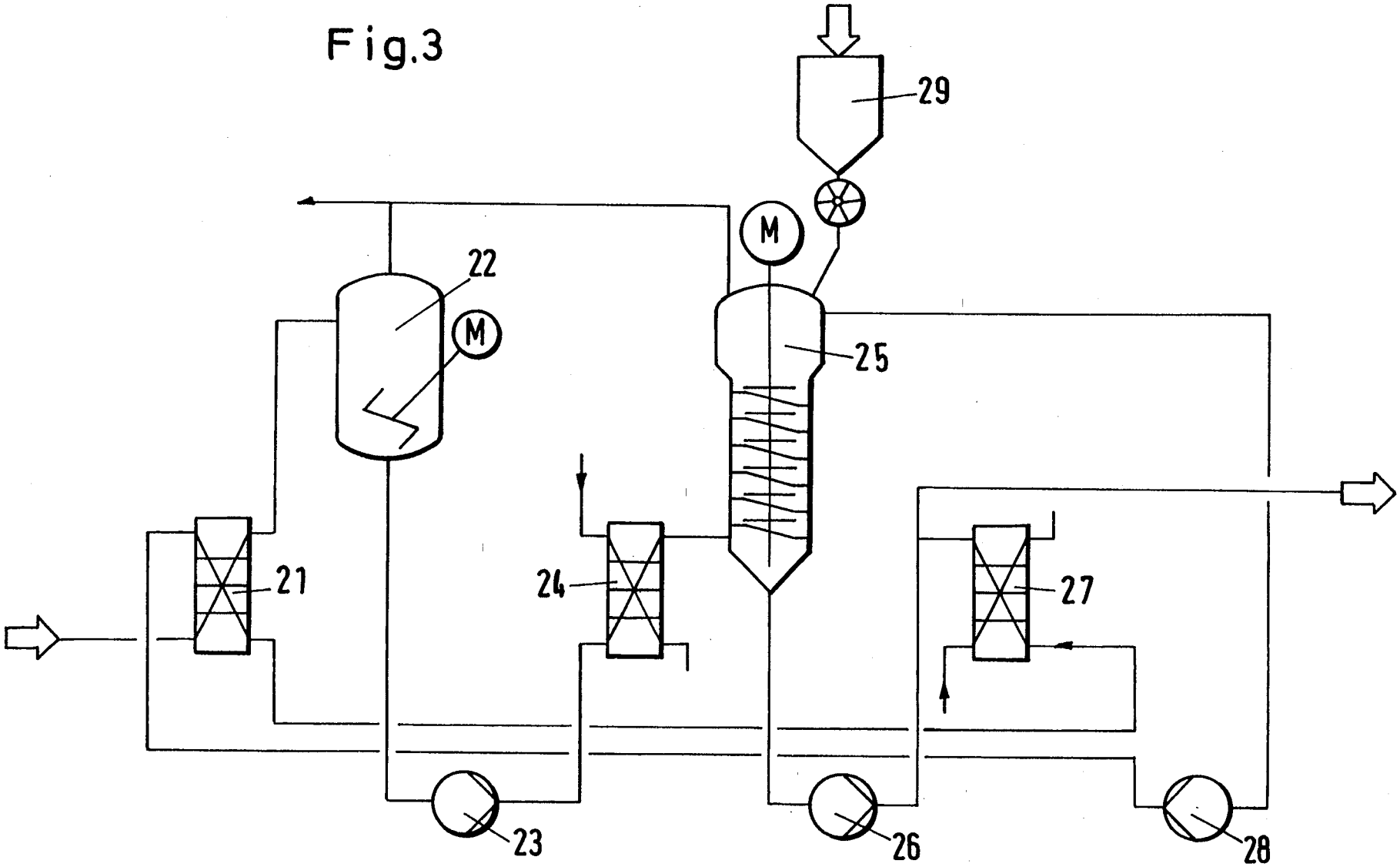
FIG. 3 is a diagrammatic representation of a third embodiment for carrying out a further alternative of the method.

FIG. 3 represents diagrammatically a flow chart of a plant for the continuous counterflow bleaching of vegetable oil.

The unbleached oil is fed to the plant continuously and the oil-oil heat exchanger 21 is pre-heated by the fully bleached oil. In the drier 22 the water content of the oil is reduced by vacuum.

Before the pump 23 feeds the oil out of the drier 22 into a bleacher 25, an oil heater 24 heats it to bleaching temperature. The bleacher 25 is constructed as a centrifugal counter flow column.

Bleaching earth or adsorbent clay is furthermore metered into the bleacher 25 from the bleaching earth storage vessel 29.

While at the foot of the bleacher 25 the turbid runnings are drawn off, the clear runnings leave the bleacher 25 at the column head. The clear runnings are pumped by means of a pump 28 through the oil-oil heat exchanger 21 and an oil cooler 27 for the purpose of cooling.

A pump 26 sucks the turbid runnings out of the bleacher 25. Before clear and turbid runnings of the bleacher 25 leave the plant for joint filtration, they are combined.

Figure 4:
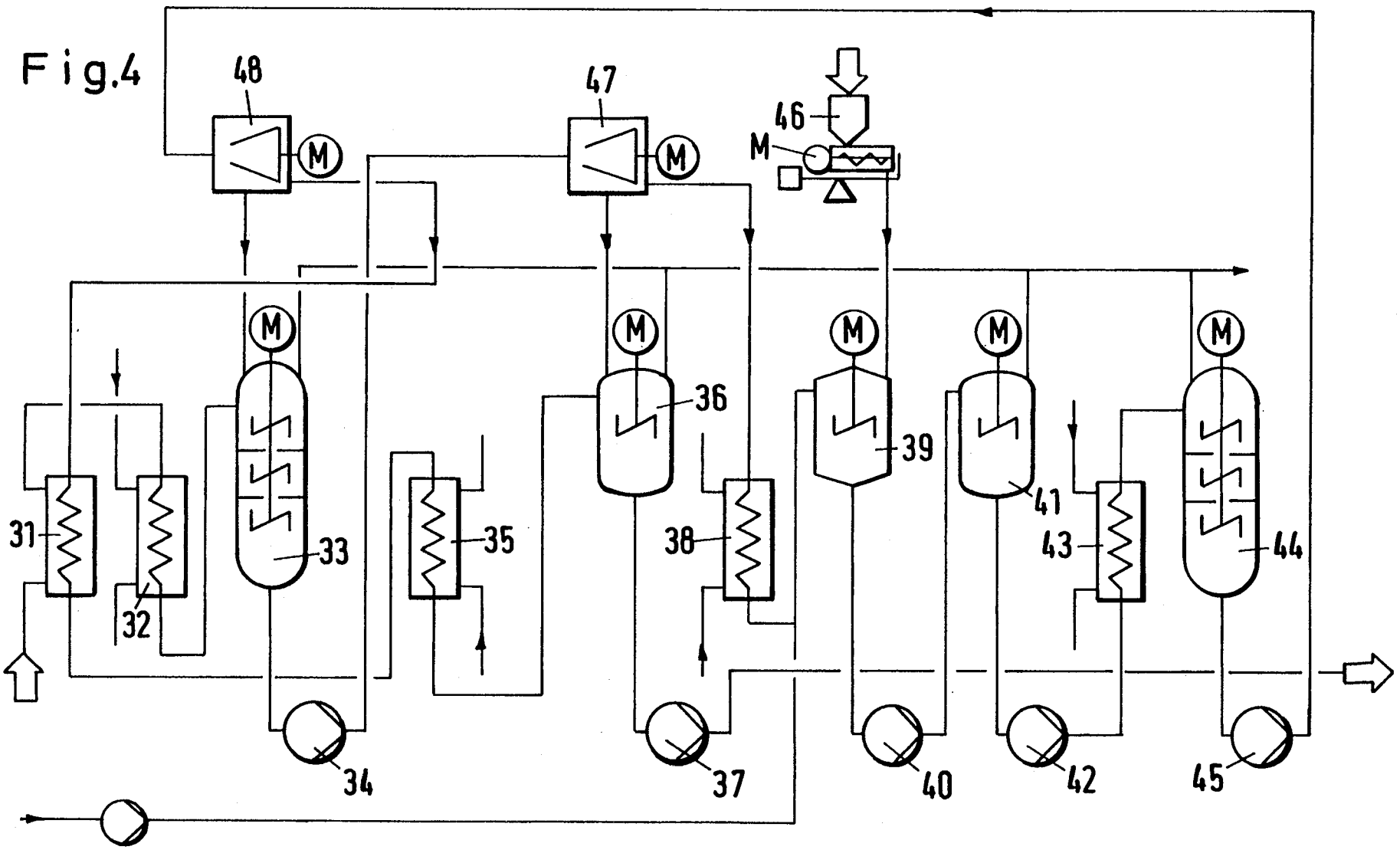
FIG. 4 is a diagrammatic representation of a fourth embodiment for carrying out a further method.

FIG. 4 shows a plant for the two-stage, continuous counterflow bleaching of vegetable oils in the form of a flow chart. The unbleached oil is pre-heated in an oil-oil heat exchanger 31 by the fully bleached oil. Before the oil passes into a bleacher 33, it is heated in an oil heater 32 to process temperature.

In the bleacher 33 there takes place the pre-bleaching of the oil with once used bleaching earth or adsorbent clay from a centrifuge 48.

A pump 34 feeds the oil-bleaching earth suspension out of the bleacher 33 to a centrifuge 47. The turbid runnings of the centrifuge 47 pass into the mixer 36. The clear runnings are cooled in an oil cooler 38, mixed with citric acid, before they are agitated in the mixer 39 with fresh bleaching earth.

The metering device 46 ensures a continuous feed of bleaching earth.

By means of a pump 40 the suspension is conveyed out of the mixer 39 into an oil drier 41. Via the oil heater 43 a pump 42 pumps the suspension into the bleacher 44. The pump 45 feeds the suspension to the centrifuge 48.

The turbid runnings from the centrifuge 48 drop into the bleacher 33 for the purpose of oil pre-bleaching.

The clear runnings contain the fully bleached oil. It is passed after cooling with the unbleached oil in the oil-oil heat exchanger 31 through the oil cooler 35 into the mixer 36. The mixer 36 agitates the fully bleached oil with the twice used bleaching earth from the centrifuge 47. By means of the pump 37 the suspension leaves the bleaching process in the direction of the filtration.

What is claimed is:

1. Method for the adsorptive purification of vegetable and/or mineral oils and fats in a multi-stage counter flow process comprising first and last separating stages and subsequent filter means, wherein at least part of an adsorbent leaving said first separating stage of said multi-stage process is mixed in batches or continuously with a part of the purified oil or fat leaving said last separating stage to produce a mash, and wherein said mash is fed to said subsequent filter means.

2. Method according to claim 1, wherein said mash is fed to the subsequent filter means as a precoating medium, in each case after a filter cleaning.

3. Method according to claim 2, wherein a turbid oil collects in a precoating phase of said filter means and is returned to an unpurified oil to be fed to said multi-stage counterflow process.

4. Method according to claim 3, wherein said filter means comprises two parallel connected filter stages, said stages being carried out after said last separating stage and alternately disconnected, cleaned and precoated afresh, whereby a continuous discharge of purified oil or fat takes place.

5. Method according to claim 2, wherein said filter means comprises two parallel connected filter stages, said stages being carried out after said last separating stage and alternately disconnected, cleaned and precoated afresh, whereby a continuous discharge of purified oil or fat takes place.

6. Method according to claim 1, wherein continuously a solid phase leaving said first separating stage is combined with a purified oil and fat of said last separating stage and fed to the subsequent filter means.

7. A method of purifying a liquid containing pigmentations and dirt contaminants and selected from the group which consists of vegetable oils, mineral oils, fats and mixtures thereof, said method comprising the steps of:

(a) contacting said liquid with a solid adsorbent capable of bleaching the liquid and adsorbing said contaminants therefrom for a time and at a temperature in counterflow and in a plurality of stages with separation of phases including an initial stage at which a contaminated adsorbent is recovered and a final stage at which a purified liquid is recovered;

(b) mixing at least some of said contaminated adsorbent recovered in step (a) with at least part of the purified liquid recovered in step (a) to form a mash; and (c) feeding said mash to a filter and depositing solids from sad mash on said filter while filtering purified liquid through said filter.

8. The method defined in claim 7, further comprising the steps of:

cleaning said filter following deposition of solids thereon and filtering of said purified liquid therethrough; and precoating said filter after the cleaning thereof by applying said mash to said filter.

9. The method defined in claim 8, further comprising the steps of:

collecting a turbid liquid traversing said filter during the precoating thereof; and feeding the collected turbid liquid to said initial state.

10. The method defied in claim 9 wherein during filtering of purified liquid on a first filter after cleaning a precoating thereof, another filter is cleaned ad precoated, the filtering of purified liquid being switched to said other filter and said first filter being cleaned and precoated in alternation.

11. The method defined in claim 7 wherein said solid adsorbent form said initial stage and the purified liquid from said final stage are continuously mixed together and fed continuously to at least one filter.

* * * * *